US005424926A

United States Patent [19]

Myers

[11] Patent Number: 5,424,926

[45] Date of Patent: Jun. 13, 1995

[54] PURSE LIGHT

[76] Inventor: Scott A. Myers, 1090 Hyde Park Road, Apt. A, London, Ontario, Canada, N0M 1Z0

[21] Appl. No.: 308,687

[22] Filed: Sep. 19, 1994

[51] Int. Cl.[6] ..... A45C 15/06

[52] U.S. Cl. ..... 362/156; 362/155; 362/191; 362/200; 362/253

[58] Field of Search ..... 362/154, 156, 191, 200, 362/253, 23, 155, 802, 396, 223

[56] References Cited

U.S. PATENT DOCUMENTS 4,654,763 3/1987 Knight ..... 362/156

4,954,934 9/1990 Kidder et al. ..... 362/156

5,018,057 5/1991 Biggs et al. ..... 362/200 X 5,347,440 9/1994 Roberts et al. ..... 362/200

*Primary Examiner*—Stephen F. Husar

[57] ABSTRACT

A light for illuminating an interior of a purse. The inventive device includes a housing mounting a light bulb therewithin. A reflector is positioned about the light bulb to direct light towards a diffusing lens which projects the light in a plurality of directions. The device includes a mounting assembly permitting selective removal of the device from the purse, and a digital clock for indicating the time of day.

10 Claims, 5 Drawing Sheets

PURSE LIGHT

BACKGROUND OF THE INVENTION

1. Field of the Invention

The present invention relates to lights and more particularly pertains to a purse light for illuminating an interior of a purse.

2. Description of the Prior Art

The use of lights is known in the prior art. More specifically, lights heretofore devised and utilized for the purpose of illuminating objects are known to consist basically of familiar, expected and obvious structural configurations, notwithstanding the myriad of designs encompassed by the crowded prior art which have been developed for the fulfillment of countless objectives and requirements.

For example, a purse light is illustrated in U.S. Pat. No. 4,742,438 for illuminating the interior of a lady's purse. The apparatus includes a light bulb and an electric power supply mounted within a translucent housing. The housing is temporarily mounted on a mounting bracket, which is permanently mounted to the interior of the purse. The mounting bracket has a pair of tabs, which engage holes in the housing to secure the device thereto.

Another patent of interest is U.S. Pat. No. 4,912,611 which discloses a purse light having a separate control switch which can be rapidly moved from handbag to handbag of either the rigid frame construction or the foldable fabric type. The device includes a light source having a flexible electrical conductor connecting the light source to the control switch, thereby permitting moving of the light source to various locations for inspecting the external compartments of the handbag as well as illuminating the keyhole in a door or automobile ignition lock.

Other known prior art lights are disclosed in U.S. Pat. Nos. 5,001,462; 4,954,934; 3,576,989; U.S. Des. Nos. 298,658; and 293,737.

While these devices fulfill their respective, particular objectives and requirements, the aforementioned patents do not disclose a purse light for illuminating an interior of a purse which includes a housing mounting a light bulb therewithin, and a reflector positioned about the light bulb to direct light towards a diffusing lens which projects the light in a plurality of directions. Furthermore, none of the known prior art lights teach or suggest a purse light of the aforementioned structure which further includes a mounting assembly permitting selective removal of the purse light from the purse, and a digital clock for indicating the time of day.

In these respects, the purse light according to the present invention substantially departs from the conventional concepts and designs of the prior art, and in so doing provides an apparatus primarily developed for the purpose of illuminating an interior of a purse.

SUMMARY OF THE INVENTION

In view of the foregoing disadvantages inherent in the known types of lights now present in the prior art, the present invention provides a new purse light construction wherein the same can be utilized illuminating an interior of a purse. As such, the general purpose of the present invention, which will be described subsequently in greater detail, is to provide a new purse light apparatus and method which has many of the advantages of the lights mentioned heretofore and many novel features that result in a purse light which is not anticipated, rendered obvious, suggested, or even implied by any of the prior art lights, either alone or in any combination thereof.

To attain this, the present invention generally comprises a light for illuminating an interior of a purse. The inventive device includes a housing mounting a light bulb therewithin. A reflector is positioned about the light bulb to direct light towards a diffusing lens which projects the light in a plurality of directions. The device includes a mounting assembly permitting selective removal of the device from the purse, and a digital clock for indicating the time of day.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new purse light apparatus and method which has many of the advantages of the lights mentioned heretofore and many novel features that result in a purse light which is not anticipated, rendered obvious, suggested, or even implied by any of the prior art lights, either alone or in any combination thereof.

It is another object of the present invention to provide a new purse light which may be easily and efficiently manufactured and marketed.

It is a further object of the present invention to provide a new purse light which is of a durable and reliable construction.

An even further object of the present invention is to provide a new purse light which is susceptible of a low cost of manufacture with regard to both materials and labor, and which accordingly is then susceptible of low prices of sale to the consuming public, thereby making such purse lights economically available to the buying public.

Still yet another object of the present invention is to provide a new purse light which provides in the apparatuses and methods of the prior art some of the advantages thereof, while simultaneously overcoming some of the disadvantages normally associated therewith.

Still another object of the present invention is to provide a new purse light for illuminating an interior of a purse.

Yet another object of the present invention is to provide a new purse light which includes a housing mounting a light bulb therewithin and a reflector positioned about the light bulb to direct light towards a diffusing lens which projects the light in a plurality of directions.

Even still another object of the present invention is to provide a new purse light of the aforementioned structure which further includes a mounting assembly permitting selective removal of the device from the purse, and a digital clock for indicating the time of day.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
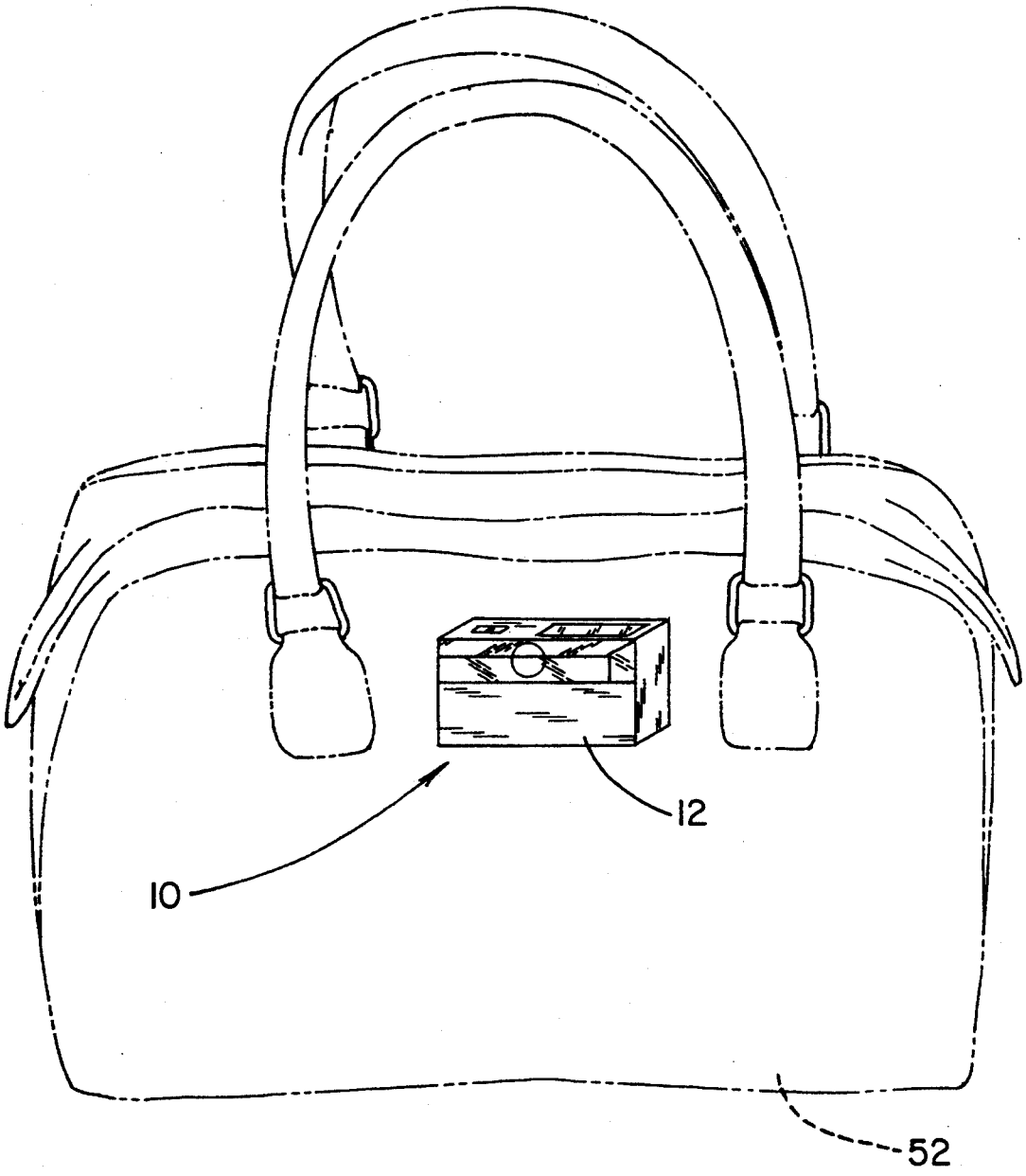
FIG. 1 is a front elevation view of a purse light comprising the present invention as installed within a purse.

With reference now to the drawings, and in particular to FIGS. 1–6 thereof, a new purse light embodying the principles and concepts of the present invention and generally designated by the reference numeral 10 will be described.

Figure 2:
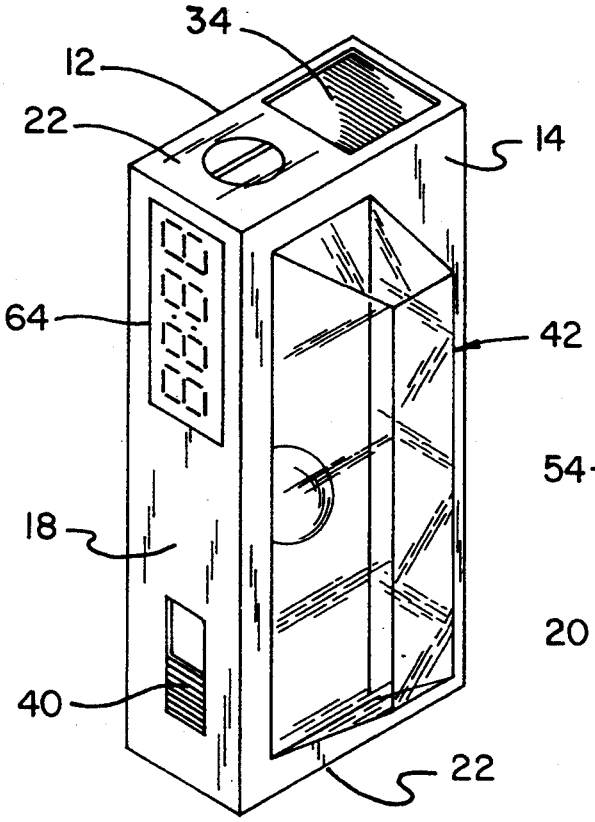
FIG. 2 is a front isometric illustration of the present invention.
Figure 3:
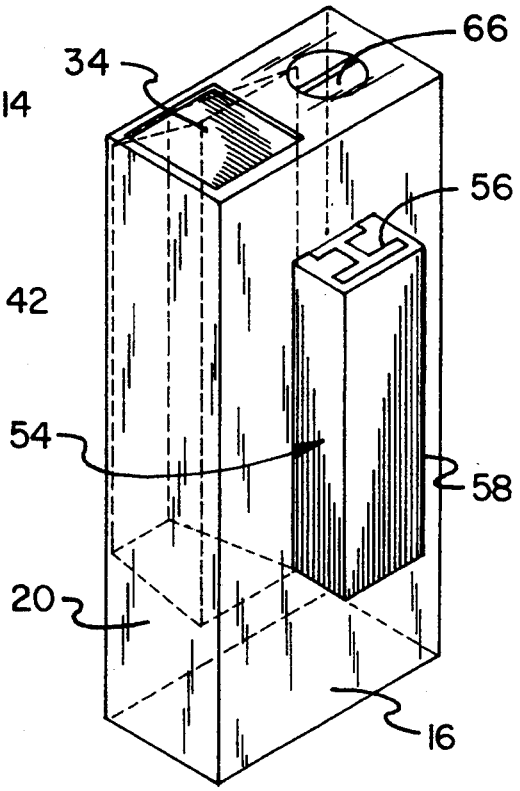
FIG. 3 is a rear isometric illustration of the purse light.
Figure 4:
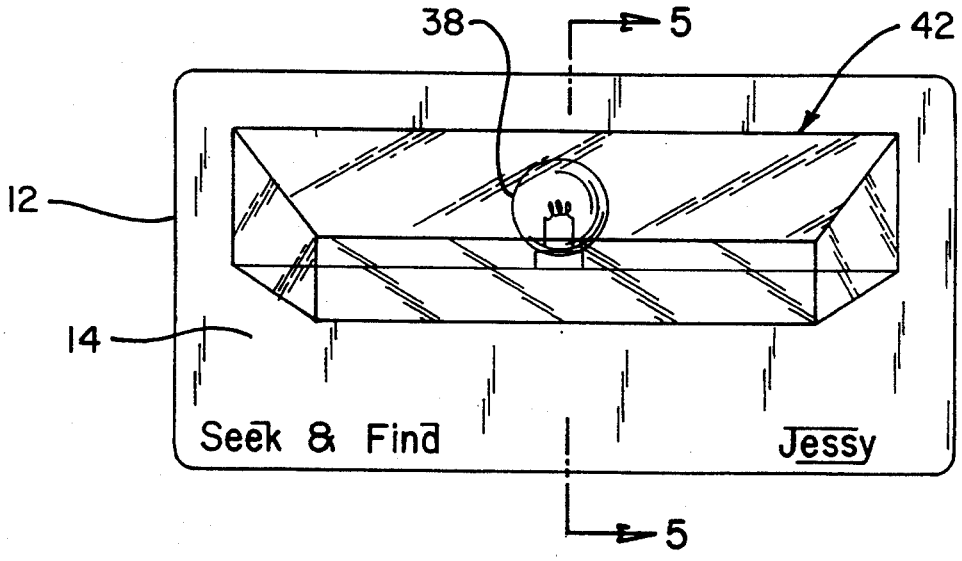
FIG. 4 is a front elevation view of the present invention.
Figure 5:
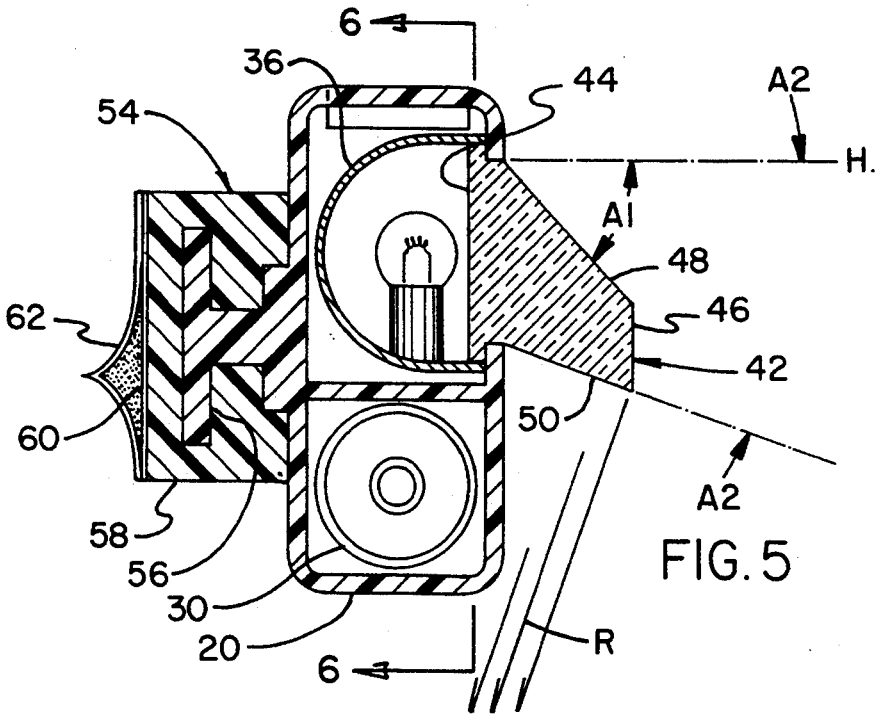
FIG. 5 is a cross sectional view taken along line 5—5 of FIG. 4.
Figure 6:
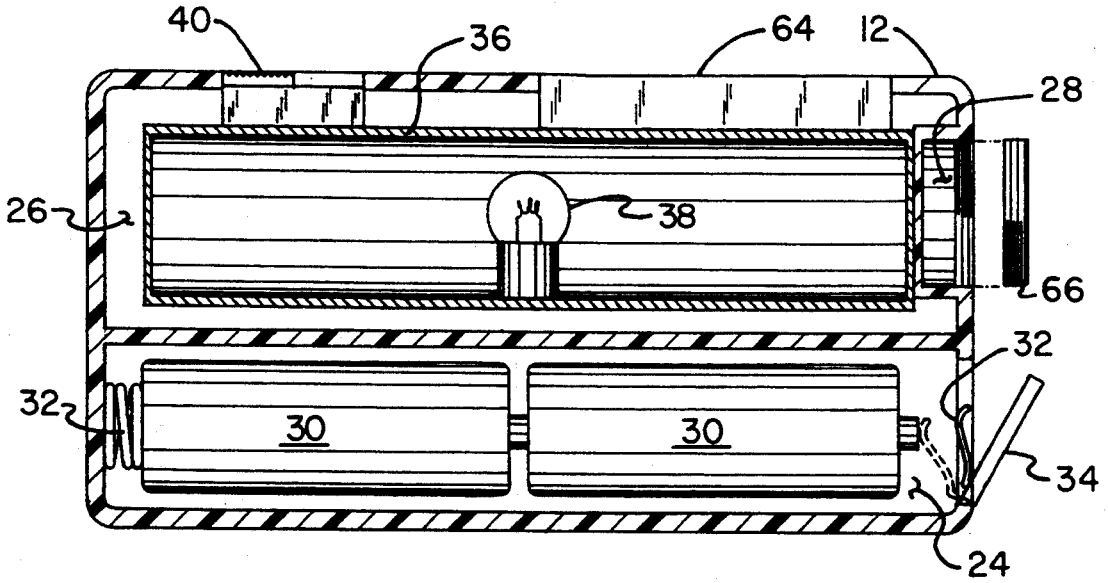
FIG. 6 is a cross sectional view taken along line 6—6 of FIG. 5.
Figure 7:
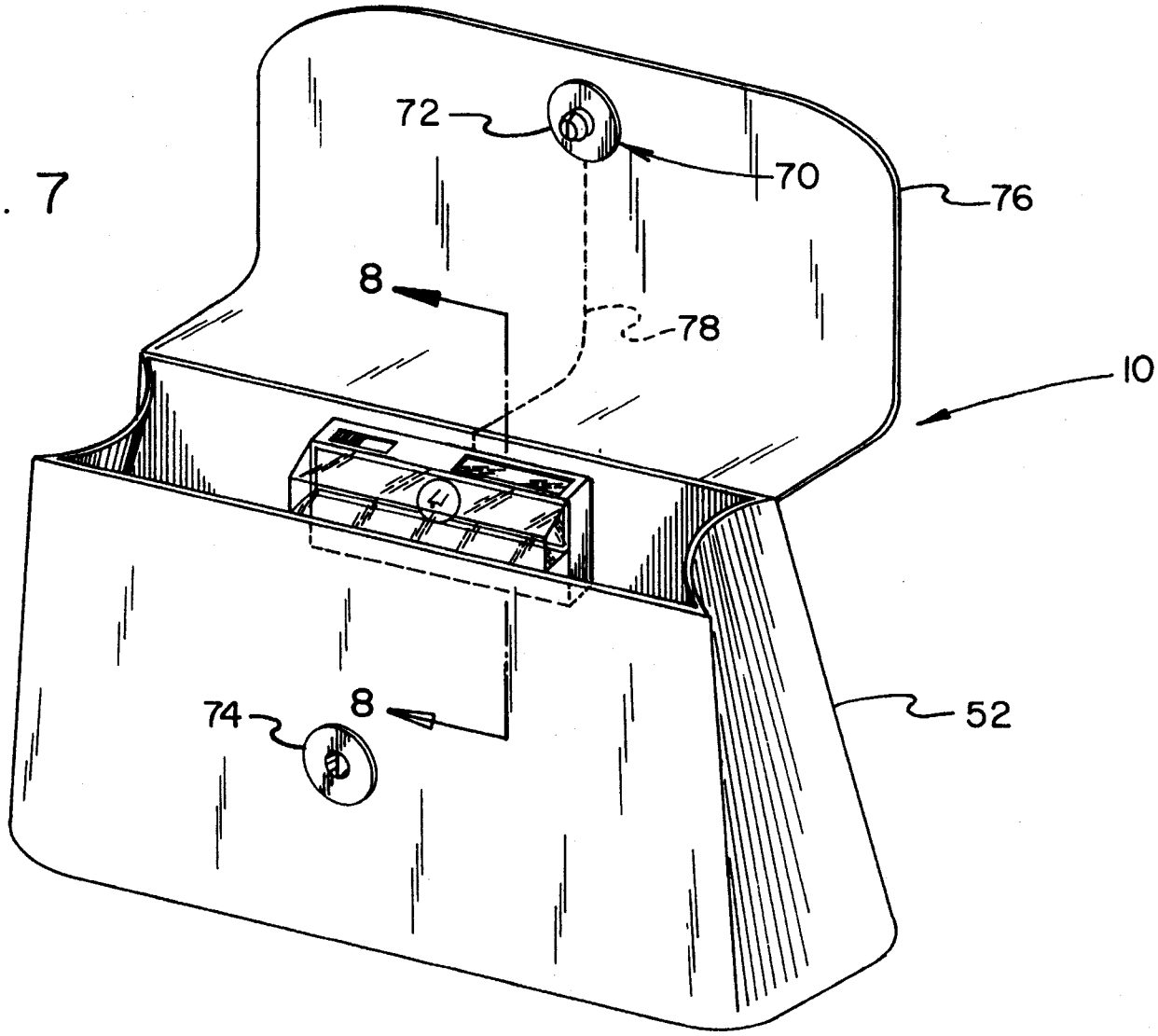
FIG. 7 is an isometric illustration of the present invention including an automatic switching means.

More specifically, it will be noted that the purse light 10 comprises a substantially rectangular housing 12 having a front wall 14 spaced from a rear wall 16, a top wall 18 spaced from a bottom wall 20, and a pair of spaced side walls 22 which cooperate to define the substantially rectangular shape of the housing, as best illustrated in FIGS. 2 and 3 of the drawings. Turning now to FIGS. 5 and 6, it can be shown that the housing 12 includes an unlabelled interior partition wall which separates the interior of the housing into a first battery compartment 24 and a light compartment 26. In addition, an unlabelled cup member is secured to one of the side walls 22 within the light compartment 26 and positioned over an aperture in such side wall so as to define a second battery compartment 28 for purposes which will hereinafter be described in more detail. The first battery compartment 24 is operable to removably contain at least one battery 30 in electrical communication with a pair of contacts 32. To this end, a cover plate 34 is pivotally mounted to a portion of the one side wall 22 so as to permit selective insertion and removal of the batteries 30 into and from the first battery compartment 24, respectively.

With continuing reference to FIGS. 5 and 6 of the drawings, it can be shown that the device 10 further comprises a substantially elongated, C-shaped reflector 36 mounted within the light compartment 26 of the housing 12. A light bulb 38 is mounted to the reflector 36 proximal a center thereof such that light rays generated by the light bulb are reflected and directed through an unlabelled front wall aperture in the front wall 14. To this end, the bulb 38 is electrically connected to a switch 40 which is, in turn, electrically connected to the contacts 32 so as to permit selective energization of the light bulb 38 as desired.

Mounted to the front wall 14 within the front wall aperture is a diffusing lens 42 which directs light rays emanating from the light bulb 38 into a plurality of directions. To this end, the diffusing lens 42 is comprised of a substantially transparent or translucent material and is shaped so as to define a rear face 44 and a front face 46 positioned in a substantially parallel, spaced relationship. The rear face 44 is of a length substantially longer than a length of the front face 46, as best illustrated in FIG. 5. The diffusing lens 42 also includes an upper face 48 having an unlabelled upper face length and a lower face 50 having an unlabelled lower face length, wherein the upper face length is substantially slightly greater than the lower face length. Further, the upper face 48 is oriented at an angle "A1" from a horizontal reference line "H", and the lower face is oriented at a second angle "A2" from the horizontal reference line, wherein the first angle is substantially greater than the second angle so as to define the substantially trapezoidal cross section illustrated in FIG. 5. By this structure, light rays emanating from the light bulb 38 are directed upwardly from the upper face 48, outwardly from the front face 46, and downwardly from the lower face 50. Because the diffusing lens 42 projects outwardly the housing 12 and the lower face 50 is oriented at the second angle "A2" from the horizontal reference line "H" as illustrated in FIG. 5, light rays "R" exiting the diffusing lens 42 from the lower face are permitted to project beneath the housing 12 to illuminate an area beneath the bottom wall 20. Thus, the diffusing lens 42, because of its specific shape, provides for complete illumination of the interior of a purse 52 during use.

To mount the device 10 within the purse 52, as illustrated in FIG. 1, a mounting means 54 is provided. The mounting means 54 is illustrated in FIGS. 3 and 5 of the drawings and it can be seen from these Figures that the mounting means comprises a substantially T-shaped mount 56 which is integrally or otherwise fixedly secured to the rear wall 16 of the housing 12. Further, a receptacle 58 having a substantially T-shaped receiving channel extending longitudinally therethrough is provided and may be coupled to the interior surface of the purse 52 by an adhesive 60 or the like, rivets. Preferably, the receptacle 58 includes adhesive 60 covered by a removable backing 62 which may be removed to expose such adhesive for subsequent securement to the interior of the purse 52. By this structure, the receptacle 58 may be secured to the interior of the purse, whereby the T-shaped mount 56 may be slidably engaged to the T-shaped channel of the receptacle to removably couple the device 10 thereto.

In addition, the device 10 may also include a digital clock 64 mounted to the housing 12 along the top wall thereof for indicating the time of day. Preferably, the digital clock 64 includes its own battery separate from the batteries 30 utilized to power the light bulb 38. In this respect, should the light bulb 38 be accidentally left on, thereby draining the power from the batteries 30, the digital clock 64, because of its independent power supply, will not be effected from such loss of power. To this end, a clock battery, such as a button battery or the like can be removably stored within the second battery compartment 28 by a removable plug 66 which threadably engages a portion of the one side wall 22. Although not illustrated, suitable contacts and wiring to couple such button battery to the digital clock 64 should be provided.

Figure 8:
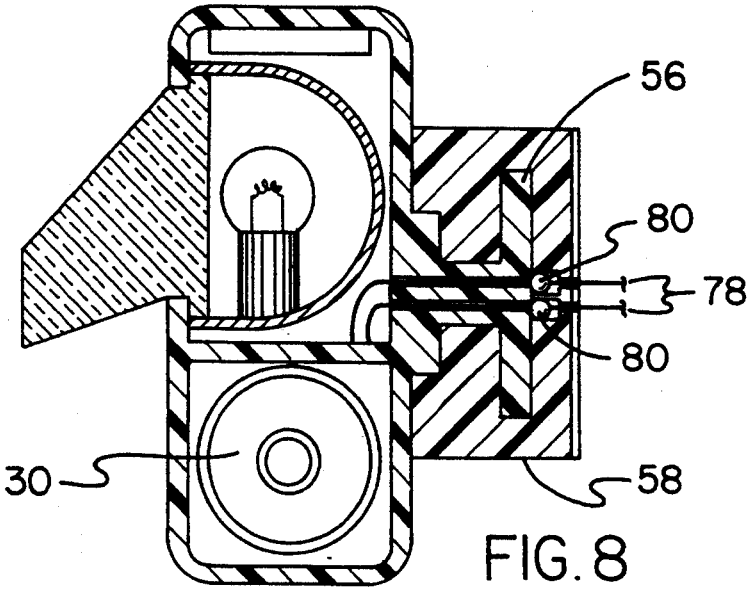
FIG. 8 is a cross sectional view taken along line 8—8 of FIG. 7.

FIGS. 7 through 10 illustrate a modification of the present invention 10 to include an automatic switching means 70 for automatically energizing the light bulb 38 upon an opening of the associated purse 52. To this end, the automatic switching means 70 comprises a closure catch 72 which may be releasably engaged to a receiver 74 to secure an openable portion 76 to the remainder thereof. As best illustrated in FIG. 8, the device 10 is provided with a pair of wires 78 which communicate with the light bulb 38 through a pair of spherical contacts 80 mounted in the receptacle 58. The spherical contacts 80 permit electrical communication between the wires 78 and the light bulb 38 while still permitting selective removal of the T-shaped mount from the receptacle such that the device 10 can be removed from the purse 52 when unit (10) is removed from purse (52), contacts (80) touch to make a flowing circuit so that switch (40) can now operate unit (10) when unit (10) is removed from purse (52).

Figure 9:
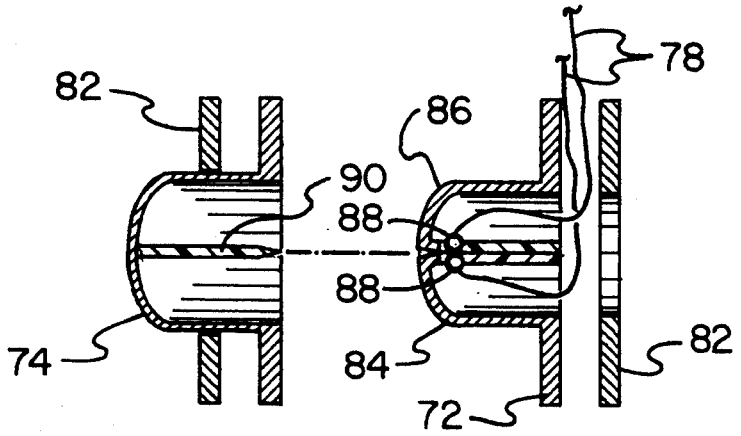
FIG. 9 is a cross sectional of a portion of the automatic switching means.
Figure 10:
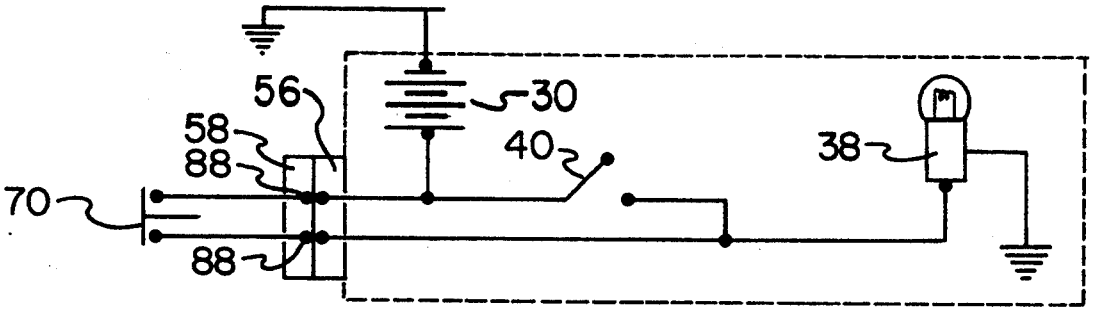
FIG. 10 is a diagrammatic electrical circuitry of the automatic switching means.

Referring now to FIG. 9, it can be shown that the closure latch 72 and the receiver 74 can be mounted to the purse 52 by suitable adhesive or the like, with a retainer 82 further securing and concealing such mounting. The closure latch 72 comprises a first semi-cylindrical portion 84 adjacent to a second semi-cylindrical portion 86, with the first and second semi-cylindrical portions being receivable within a cavity of the receiver 74 to secure the openable portion 76 of the purse to the remainder of the purse. The first and second semi-cylindrical portions 84, 86 further cooperate to support a pair of latch contacts 88 in a normally closed position. Both latch contacts including latch (72) and receiver (74) must be made of plastic, for plastic is a non-conductor. Only latch contacts (88) can be made of metal and wire. The latch contacts, however, will be biased into an open position upon engagement of the closure latch 72 with the receiver 74 by a dielectric breaker projection 90. Thus, upon opening of the portion 76 of the purse 52, the latch contacts 88 will be permitted to close, thereby energizing the light bulb 38. The electrical diagram of FIG. 10 illustrates the electrical interconnections of the automatic switching means which will accomplish this result.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new purse light comprising:

a substantially rectangular housing having a front wall spaced from a rear wall, a top wall spaced from a bottom wall, and a pair of spaced side walls which cooperate to define a substantially rectangular shape of said housing, said housing also including an unlabelled interior partition wall which separates said interior of said housing into a light compartment and a first battery compartment for containing at least one battery, said housing front wall having an aperture extending therethrough;

a substantially elongated reflector mounted within said light compartment of said housing;

a light bulb mounted within said housing proximal to a center of said reflector such that light rays generated by said light bulb are reflected and directed through a said aperture in said front wall;

a switch electrically coupled to said bulb, said switch being electrically couplable to said at least one battery so as to permit selective energization of said light bulb;

a diffusing lens mounted to said front wall within said aperture, said lens being operable to direct light rays emanating from said light bulb into a plurality of directions; and, mounting means for removably mounting said purse light within a purse.

2. The new purse light of claim 1, wherein said diffusing lens comprises a lens material shaped so as to define a rear face and a front face positioned in a substantially parallel, spaced relationship, with said rear face being of a length substantially longer than a length of said front face, said diffusing lens also including an upper face having an upper face length and a lower face having a lower face length, wherein said upper face length is substantially slightly greater than said lower face length, said upper face being oriented at a first angle from a horizontal reference line extending orthogonally from said rear face, and said lower face being oriented at a second angle from said horizontal reference line, wherein said first angle is substantially greater than said second angle so as to define a substantially trapezoidal cross section of said lens such that light rays emanating from said light bulb are directed upwardly from said upper face, outwardly from said front face, and downwardly from said lower face.

3. The new purse light of claim 1, wherein said mounting means comprises a substantially T-shaped mount fixedly secured to said rear wall of said housing, and a receptacle having a substantially T-shaped receiving channel extending longitudinally therethrough, said receptacle being mountable within said purse and being operable to receive a portion of said T-shaped within said channel to mount said purse light within said purse.

4. The new purse light of claim 3, wherein said receptacle includes adhesive covered by a removable backing which may be removed to expose such adhesive for subsequent securement of said receptacle said purse.

5. The new purse light of claim 4, and further comprising an automatic switching means for energizing said light bulb upon an opening of a portion of said purse.

6. The new purse light of claim 1, and further comprising a digital clock mounted to said housing along said top wall thereof.

7. A new purse light comprising:

a substantially rectangular housing having a front wall spaced from a rear wall, a top wall spaced from a bottom wall, and a pair of spaced side walls which cooperate to define a substantially rectangular shape of said housing, said housing also including an unlabelled interior partition wall which separates said interior of said housing into a light compartment and a first battery compartment for containing at least one battery, said housing front wall having an aperture extending therethrough;

a substantially elongated reflector mounted within said light compartment of said housing;

a light bulb mounted within said housing proximal to a center of said reflector such that light rays generated by said light bulb are reflected and directed through a said aperture in said front wall;

a switch electrically coupled to said bulb, said switch being electrically couplable to said at least one battery so as to permit selective energization of said light bulb;

a diffusing lens mounted to said front wall within said aperture, said lens being operable to direct light rays emanating from said light bulb into a plurality of directions, said diffusing lens comprising a lens material shaped so as to define a rear face and a front face positioned in a substantially parallel, spaced relationship, with said rear face being of a length substantially longer than a length of said front face, said diffusing lens also including an upper face having an upper face length and a lower face having a lower face length, wherein said upper face length is substantially slightly greater than said lower face length, said upper face being oriented at a first angle from a horizontal reference line extending orthogonally from said rear face, and said lower face being oriented at a second angle from said horizontal reference line, wherein said first angle is substantially greater than said second angle so as to define a substantially trapezoidal cross section of said lens such that light rays emanating from said light bulb are directed upwardly from said upper face, outwardly from said front face, and downwardly from said lower face; and, mounting means for removably mounting said purse light within a purse, said mounting means comprising a substantially T-shaped mount fixedly secured to said rear wall of said housing, and a receptacle having a substantially T-shaped receiving channel extending longitudinally therethrough, said receptacle being mountable within said purse and being operable to receive a portion of said T-shaped within said channel to mount said purse light within said purse, said receptacle including an adhesive covered by a removable backing which may be removed to expose such adhesive for subsequent securement of said receptacle said purse.

8. The new purse light of claim 7, and further comprising a digital clock mounted to said housing along said top wall thereof.

9. A new purse light comprising:

a substantially rectangular housing having a front wall spaced from a rear wall, a top wall spaced from a bottom wall, and a pair of spaced side walls which cooperate to define a substantially rectangular shape of said housing, said housing also including an unlabelled interior partition wall which separates said interior of said housing into a light compartment and a first battery compartment for containing at least one battery, said housing front wall having an aperture extending therethrough, said housing further having a cup member secured to one of said side walls and positioned over an aperture in said one of said side walls so as to define a second battery compartment;

a substantially elongated reflector mounted within said light compartment of said housing;

a light bulb mounted within said housing proximal to a center of said reflector such that light rays generated by said light bulb are reflected and directed through a said aperture in said front wall, with a removable plug threadably engaged to said portion of said one of said side walls so as to removably contain a clock battery within said second battery compartment;

a switch electrically coupled to said bulb, said switch being electrically couplable to said at least one battery so as to permit selective energization of said light bulb;

a diffusing lens mounted to said front wall within said aperture, said lens being operable to direct light rays emanating from said light bulb into a plurality of directions, said diffusing lens comprising a lens material shaped so as to define a rear face and a front face positioned in a substantially parallel, spaced relationship, with said rear face being of a length substantially longer than a length of said front face, said diffusing lens also including an upper face having an upper face length and a lower face having a lower face length, wherein said upper face length is substantially slightly greater than said lower face length, said upper face being oriented at a first angle from a horizontal reference line extending orthogonally from said rear face, and said lower face being oriented at a second angle from said horizontal reference line, wherein said first angle is substantially greater than said second angle so as to define a substantially trapezoidal cross section of said lens such that light rays emanating from said light bulb are directed upwardly from said upper face, outwardly from said front face, and downwardly from said lower face;

mounting means for removably mounting said purse light within a purse, said mounting means comprising a substantially T-shaped mount fixedly secured to said rear wall of said housing, and a receptacle having a substantially T-shaped receiving channel extending longitudinally therethrough, said receptacle being mountable within said purse and being operable to receive a portion of said T-shaped within said channel to mount said purse light within said purse, said receptacle including an adhesive covered by a removable backing which may be removed to expose such adhesive for subsequent securement of said receptacle said purse; and, a digital clock mounted to said housing along said top wall thereof, said digital clock being electrical communicable with said clock battery.

10. The new purse light of claim 9, and further comprising an automatic switching means for energizing said light bulb upon an opening of a portion of said purse.

* * * * *